US008388802B2

(12) United States Patent
Buzza et al.

(10) Patent No.: US 8,388,802 B2
(45) **Date of Patent: *Mar. 5, 2013**

(54) PAPER SUBSTRATES USEFUL IN WALLBOARD TAPE APPLICATIONS

(75) Inventors: Stephen A. Buzza, Ovilla, TX (US); Dennis W. Anderson, Goshen, OH (US); Yufeng Xu, Loveland, OH (US); Bruce Richard McGaffin, Middletown, OH (US); Christopher Michael Wilson, Middletown, OH (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/439,905

(22) Filed: Apr. 5, 2012

(65) Prior Publication Data

US 2012/0193055 A1 Aug. 2, 2012

Related U.S. Application Data

(60) Division of application No. 12/859,309, filed on Aug. 19, 2010, now Pat. No. 8,152,961, which is a continuation of application No. 11/352,941, filed on Feb. 13, 2006, now Pat. No. 7,789,996.

(60) Provisional application No. 60/652,097, filed on Feb. 11, 2005.

(51) Int. Cl.

| | |
|---|---|
| ***D21H 27/18*** | (2006.01) |
| ***D21H 21/14*** | (2006.01) |
| ***D21H 21/16*** | (2006.01) |
| ***D21H 21/20*** | (2006.01) |

(52) U.S. Cl. ..... 162/109; 162/158; 162/164.3; 162/164.6; 162/168.3; 162/181.2; 162/135; 162/160; 162/183; 162/194; 162/204

(58) Field of Classification Search ..... 162/109, 162/141, 158, 164.1, 164.3, 164.6, 168.1, 162/168.3, 181.1, 181.2, 175, 178, 135–137, 162/160–161, 179, 183–185, 194, 204; 428/156, 428/688, 221, 537.5; 156/39; 427/358, 361, 427/391

See application file for complete search history.

(56) References Cited

U.S. PATENT DOCUMENTS

| | | | |
|---|---|---|---|
| 2,667,822 | A | 2/1954 | Christman |
| 3,392,085 | A | 7/1968 | Oliver |
| 3,616,165 | A | 10/1971 | Nishi |
| 3,630,830 | A | 12/1971 | Herdle et al. |
| 3,640,756 | A | 2/1972 | Beersma et al. |
| 3,767,604 | A | 10/1973 | Hjermstad et al. |
| 3,941,728 | A | 3/1976 | Solenberger |
| 3,950,593 | A | 4/1976 | Bomball et al. |
| 4,022,965 | A | 5/1977 | Goheen et al. |
| 4,041,202 | A | 8/1977 | Williams |
| 4,042,739 | A | 8/1977 | Emal et al. |
| 4,075,136 | A | 2/1978 | Schaper |
| 4,128,286 | A | 12/1978 | Windisch et al. |
| 4,166,894 | A | 9/1979 | Schaper |
| 4,174,417 | A | 11/1979 | Rydell |
| 4,184,914 | A | 1/1980 | Jenkins |
| 4,294,888 | A | 10/1981 | Antonio et al. |
| 4,372,814 | A | 2/1983 | Johnstone et al. |
| 4,386,183 | A | 5/1983 | Wempe |
| 4,431,481 | A | 2/1984 | Drach et al. |
| 4,440,830 | A | 4/1984 | Wempe |
| 4,448,639 | A | 5/1984 | Long |
| 4,496,427 | A | 1/1985 | Davison |
| 4,548,676 | A | 10/1985 | Johnstone et al. |
| 4,665,014 | A | 5/1987 | Katsura |
| 4,710,422 | A | 12/1987 | Fredenucci |
| 4,792,473 | A | 12/1988 | Vitale |
| 4,853,085 | A | 8/1989 | Johnstone et al. |
| 4,986,882 | A | 1/1991 | Mackey et al. |
| 5,011,741 | A | 4/1991 | Hoffman |
| 5,049,235 | A | 9/1991 | Barcus et al. |
| 5,160,789 | A | 11/1992 | Barcus et al. |
| 5,209,953 | A | 5/1993 | Grupe et al. |
| 5,240,500 | A | 8/1993 | Retti |
| 5,266,250 | A | 11/1993 | Kroyer |
| 5,350,630 | A | 9/1994 | Schreiner et al. |
| 5,360,420 | A | 11/1994 | Cook et al. |
| 5,443,899 | A | 8/1995 | Barcus et al. |
| 5,527,430 | A | 6/1996 | Gill |
| 5,531,728 | A | 7/1996 | Lash |
| 5,547,764 | A | 8/1996 | Blais et al. |
| 5,585,456 | A | 12/1996 | Dulany et al. |
| 5,613,335 | A | 3/1997 | Rennich et al. |
| 5,662,773 | A | 9/1997 | Frederick et al. |
| 5,667,637 | A | 9/1997 | Jewell et al. |

(Continued)

FOREIGN PATENT DOCUMENTS

| | | |
|---|---|---|
| AU | 2006213665 | 8/2006 |
| CA | 2508688 | 9/2006 |

(Continued)

OTHER PUBLICATIONS

G A. Smook, "Handbook for Pulp and Papper Technologists," 1992, Angus wilde Publications, 2nd edition, p. 220-227. cited by examiner.

(Continued)

*Primary Examiner* — José A Fortuna

(74) *Attorney, Agent, or Firm* — Thomas W. Barnes, III; Eric W. Guttag

(57) ABSTRACT

This invention relates to paper products and/or substrates suitable for being made and/or converted into wallboard tape; which also may be known as joint tape and/or drywall tape, having a pH of at least 7.0 and containing a plurality of cellulose fibers, a wet strength additive, an alkaline sizing agent, and an anionic promoter, as well as methods of making and using the same.

33 Claims, 1 Drawing Sheet

U.S. PATENT DOCUMENTS

| | | | | |
|---|---|---|---|---|
| 5,685,815 | A | 11/1997 | Bottorff et al. | |
| 5,698,074 | A | 12/1997 | Barcus et al. | |
| 5,698,688 | A | 12/1997 | Smith et al. | |
| H1704 | H | 1/1998 | Wallajapet et al. | |
| 5,711,124 | A | 1/1998 | Stough et al. | |
| 5,766,417 | A | 6/1998 | Brungardt | |
| 5,773,131 | A | 6/1998 | Dettling | |
| 5,836,122 | A | 11/1998 | Rennich et al. | |
| 5,866,618 | A | 2/1999 | Nguyen et al. | |
| 6,033,526 | A | 3/2000 | Ehrhardt et al. | |
| 6,077,906 | A | 6/2000 | Thiruvengada et al. | |
| 6,116,999 | A | 9/2000 | Montross | |
| 6,126,783 | A | 10/2000 | Gill | |
| 6,133,170 | A | 10/2000 | Suenaga et al. | |
| 6,146,494 | A | 11/2000 | Seger et al. | |
| 6,165,321 | A | 12/2000 | Pauley et al. | |
| 6,171,440 | B1 | 1/2001 | Staib | |
| 6,226,946 | B1 | 5/2001 | Stough et al. | |
| 6,226,957 | B1 | 5/2001 | Stough | |
| 6,228,219 | B1 | 5/2001 | Ehrhardt et al. | |
| 6,273,997 | B1 | 8/2001 | Ehrhardt et al. | |
| 6,306,255 | B1 | 10/2001 | Frolich et al. | |
| 6,316,095 | B1 | 11/2001 | Black et al. | |
| 6,355,137 | B1 | 3/2002 | Staib | |
| 6,361,651 | B1 | 3/2002 | Sun | |
| 6,432,237 | B1 | 8/2002 | Hasenkamp et al. | |
| 6,471,824 | B1 | 10/2002 | Jewell | |
| 6,500,057 | B1 | 12/2002 | Medina | |
| 6,506,282 | B2 | 1/2003 | Hu et al. | |
| 6,512,146 | B2 | 1/2003 | Pauley et al. | |
| 6,524,175 | B2 | 2/2003 | Beaudry et al. | |
| 6,579,414 | B2 | 6/2003 | Jewell | |
| 6,579,415 | B2 | 6/2003 | Jewell | |
| 6,582,557 | B2 | 6/2003 | Jewell | |
| 6,592,717 | B2 | 7/2003 | Jewell | |
| 6,595,632 | B1 | 7/2003 | Storfer Isser et al. | |
| 6,729,949 | B1 | 5/2004 | McCoy | |
| 6,869,471 | B2 | 3/2005 | Odberg et al. | |
| 7,214,434 | B2 | 5/2007 | Dalgleish et al. | |
| 7,789,996 | B2 * | 9/2010 | Buzza et al. | 162/158 |
| 8,152,961 | B2 * | 4/2012 | Buzza et al. | 162/158 |
| 2001/0051687 | A1 | 12/2001 | Bazaj et al. | |
| 2002/0062938 | A1 | 5/2002 | Westman et al. | |
| 2002/0116884 | A1 | 8/2002 | Smythe | |
| 2002/0142136 | A1 | 10/2002 | Harel | |
| 2003/0024188 | A1 | 2/2003 | Smythe | |
| 2003/0091750 | A1 | 5/2003 | Chen | |
| 2003/0181114 | A1 | 9/2003 | Newton et al. | |
| 2003/0197028 | A1 | 10/2003 | Jaekel | |
| 2003/0213196 | A1 | 11/2003 | Harel | |
| 2004/0093816 | A1 | 5/2004 | Smythe | |
| 2004/0206467 | A1 | 10/2004 | Lindgren et al. | |
| 2004/0226675 | A1 | 11/2004 | Malmstrom et al. | |
| 2005/0155731 | A1 | 7/2005 | Martin et al. | |
| 2006/0191656 | A1 | 8/2006 | Buzza et al. | |
| 2006/0254170 | A1 | 11/2006 | Goldman | |
| 2008/0128070 | A1 | 6/2008 | Goldman | |
| 2008/0254317 | A1 | 10/2008 | Xu et al. | |
| 2008/0256886 | A1 * | 10/2008 | Goldman | 52/366 |
| 2010/0092725 | A1 * | 4/2010 | Goldman | 428/137 |
| 2011/0024067 | A1 * | 2/2011 | Anderson et al. | 162/161 |
| 2011/0024068 | A1 | 2/2011 | Wild | |
| 2011/0108225 | A1 * | 5/2011 | Buzza et al. | 162/164.3 |
| 2012/0193055 | A1 * | 8/2012 | Buzza et al. | 162/164.6 |

FOREIGN PATENT DOCUMENTS

| | | |
|---|---|---|
| EP | 0540076 | 5/1993 |
| EP | 1308558 | 5/2003 |
| EP | 1632604 | 3/2006 |
| GB | 791991 | 3/1958 |
| JP | 06073700 | 3/1994 |
| JP | 07070992 | 3/1995 |
| JP | 2001081700 | 3/2001 |
| KR | 2003093389 | 12/2003 |
| WO | 200149938 | 7/2001 |
| WO | 2005042843 | 5/2005 |
| WO | 2006050848 | 5/2006 |
| WO | 2006086736 | 8/2006 |
| WO | 2008066488 | 6/2008 |
| WO | WO 2010148156 A1 * | 12/2010 |

OTHER PUBLICATIONS

J. Peel, Paper Science and Paper Manufacture 1999, pp. 18-19.

Elvanol in the Paper Industry, online du Pont de Nemours and Company, 1995-2004, 5 pages, retrieved on Jan. 4, 2009.

Smook, Gary A., Handbook of Pulp and Paper Terminology, Angus Wilde Publications, 1990, pp. 283-284.

Polyvinyl Alcohol (PVA) Chemical and Technical Assessment (CTA), 2004, Food and Agriculture Organization of the United Nations [retrieved on Jun. 30, 2011]. Retrieved from the Internet: URL: ftp://ftp.fao.org/es/esn/jecfa/cta/CTA_61_PVA.pdf.

Braga et al., "Recent Developments in Wet Strength Chemistry Targeting High Performance and Ambitious Environmental Goals," Professional Papermaking 3-4/2009, [pp. 30-34].

* cited by examiner

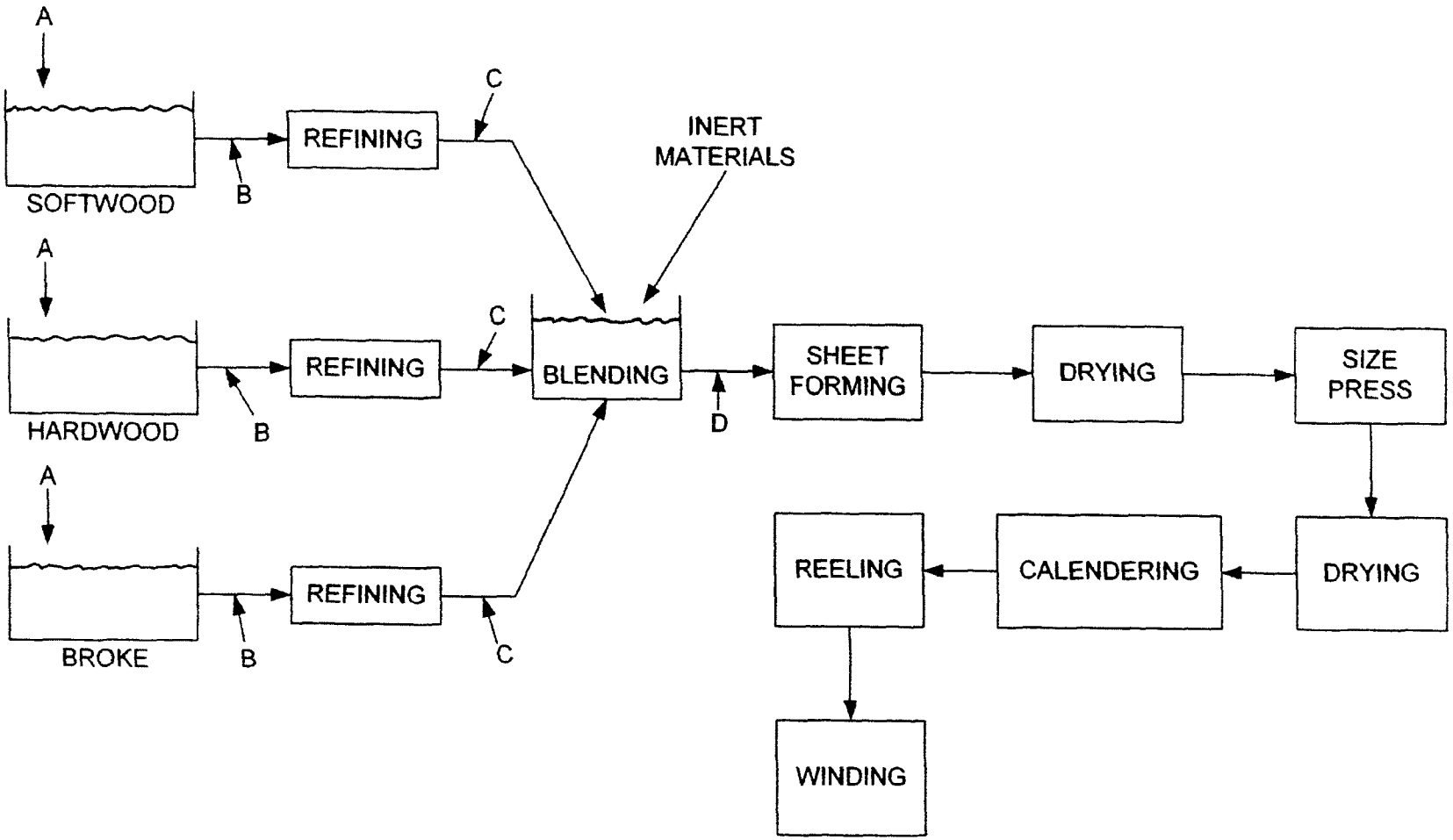
A
SOFTWOOD
B
REFINING
C
A
HARDWOOD
B
REFINING
C
A
BROKE
B
REFINING
C
INERT MATERIALS
BLENDING
D
SHEET FORMING
DRYING
SIZE PRESS
DRYING
CALENDERING
REELING
WINDING

PAPER SUBSTRATES USEFUL IN WALLBOARD TAPE APPLICATIONS

The present application is a divisional application of U.S. application Ser. No. 12/859,309 filed Aug. 19, 2010, now U.S. Pat. No. 8,152,961, which is a continuation of U.S. application Ser. No. 11/352,941 filed Feb. 13, 2006, now U.S. Pat. No. 7,789,996, which claims the benefit of priority under 35 USC §119(e) to U.S. Provisional Patent Application 60/652,097, entitled "PAPER SUBSTRATES USEFUL IN WALLBOARD TAPE APPLICATIONS", filed Feb. 11, 2005, which is hereby incorporated, in its entirety, herein by reference.

FIELD OF THE INVENTION

This invention relates to paper products and/or substrates suitable for being made into wallboard tape (also may be known as joint tape and/or drywall tape) having a pH of at least 7.0 and containing a plurality of cellulose fibers, a wet strength additive, an alkaline sizing agent, and optionally an anionic promoter therein and/or on at least one surface of the tape and/or applied onto at least one surface and dispersed in the tape. The paper substrate is characterized by its excellent physical properties including cross direction (CD) tensile, machine (MD) tensile, internal bond, wet tensile, hygroexpansivity, curl, bonding properties, bonding of joint tape to joint compound, etc. The paper product of the invention may be produced by contacting the plurality of cellulose fibers with each of the wet strength additive, alkaline sizing agent, and/or anionic promoter at any other point in the paper making process. Finally, the invention relates to methods of making and using the paper substrate.

BACKGROUND OF THE INVENTION

Wallboard (also known as drywall) has become the dominant material in the production of interior building partitions. In particular, interior building partitions generally comprise a studwall of spaced parallel vertical members (studs) which are used as a support for preformed panels (wallboard) which are attached to the studwall by screws, nails, adhesive or any other conventional attachment system. Obviously, joints exist between adjacent preformed panels. In order to provide a continuous flat surface to the wall, it is necessary to "finish" the joint between adjacent panels. Generally, such "finishing" may include the building up of multiple layers of a mastic material (joint compound) and the blending of this joint compound and paper substrate suitable for wallboard tape utility into the panel surface so as to form the desired flat and contiguous wall surface. In addition, wallboard tape may be used to bring together a plurality of panels forming a corner which may include but is not limited to corner bead.

In order to facilitate this finishing of the joints and/or corners, most manufacturers bevel the longitudinal edges of the wallboard panels so as to allow a build-up of mastic material which will then match the level of the major surface area of the preformed panel. Typically, the buildup of the mastic material in the joint area comprises the application of a first layer of mastic material, the embedding of a wallboard tape (for example a paper tape) in the first layer of mastic material and then the overcoating of the tape with one or more, generally two layers of additional mastic material. This finishing of the joints is a time consuming process, since it is generally necessary to wait 24 hours between each application of a coat of mastic material in order to allow the coat to dry before the application of an overcoat of an additional layer of mastic material. Moreover, it is then necessary generally to sand the joint area so as to produce a finish which will match the major portion of the surface area of the wallboard panels. The "finishing" process thus is both time-consuming and labor-intensive.

Wallboard tape paper is a very challenging paper to make as there is a very narrow window of operation in which to achieve the required high tensile strengths while maintaining other good physical properties such as bonding properties, bonding of joint tape to joint compound, hygroexpansivity, curl, etc. For example, conventional methods of making paper substrates suitable for use as wallboard tape require environments having pHs of less than 7.0 and/or "acidic" conditions. However, a growing number of environmental concerns are forcing paper substrate manufacturers to provide paper making environments having pH's of at least 7.0 and/or "basic" or "alkaline" conditions. The challenge to the next generation of wallboard tape paper substrate production is to program the very specific and stringent levels of physical properties such as CD tensile, MD tensile, internal bond, wet tensile, hygroexpansivity, curl, bonding properties, bond of joint tape to joint compound, etc (which are demanded by wallboard tape paper substrate converters and users) into an alkaline-based paper substrate itself prior to converting and/or use. Such levels of physical properties such as CD tensile, MD tensile, internal bond, wet tensile, hygroexpansivity, curl, bonding properties, bond of joint tape to joint compound, etc, have been achieved by conventional production of paper substrates under acidic conditions. Presently, a paper substrate made within alkaline environments and suitable for wallboard tape converting (e.g. have acceptable physical properties such as CD tensile, MD tensile, internal bond, wet tensile, hygroexpansivity, curl, bonding properties, bond of joint tape to joint compound, etc) has been difficult to achieve, limiting the supply chain of such paper substrates to only those few papermaking sources reserved for production of paper substrates under acidic conditions.

Despite the considerable efforts, there existed a need for a wallboard tape to satisfy the construction industries' requirements for an alkaline wallboard tape having highly sought after physical properties.

SUMMARY OF THE INVENTION

One object of the present invention is a paper substrate containing a plurality of cellulose fibers; a wet strength additive; an alkaline sizing agent; and optionally an anionic promoter. One aspect of the present invention is to provide a substrate having a pH of from 7.0 to 14.0. Further, another aspect of the present invention is to provide a substrate having an internal bond of from about 25 to about 350 milli ft-lb/sq. in. as measured by TAPPI method 541. An additional aspect of the present invention is a paper substrate having a basis weight of from 50 to 120 lbs/3000 sq. ft. A further aspect of the present invention is a paper substrate having an apparent density of from 5.0 to 20 lb/3000 sq. ft.per 0.001 inch thickness. A still further aspect of the present invention is a paper substrate having a MD Tensile of from 25 to 100 lbf/inch width. In addition, the paper substrate of the present invention may have a CD Tensile of from 5 to 50 lbf/inch width. Further, an aspect of the present invention is an abraded paper substrate. Still further, an aspect of the present invention is an abraded paper substrate or sanded and has a cut width of from 1.5 to 3.25 inches. The present invention also relates to methods of making and using the paper substrate, especially when such methods involve the production and use of the substrate as wallboard tape.

Another object of the present invention is a paper substrate having a pH of from 7.0 to 14.0 and containing a plurality of cellulose fibers; a wet strength additive; an alkaline sizing agent; and an anionic promoter. One aspect of the present invention is a paper substrate having a basis weight of from 50 to 120 lbs/3000 sq. ft. A further aspect of the present invention is a paper substrate having an apparent density of from 5.0 to 20 lb/3000 sq. ft.per 0.001 inch thickness. A still further aspect of the present invention is a paper substrate having a MD Tensile of from 25 to 100 lbf/inch width. In addition, the paper substrate of the present invention may have a CD Tensile of from 5 to 50 lbf/inch width. Further, an aspect of the present invention is an abraded paper substrate. Still further, an aspect of the present invention is an abraded paper substrate or sanded substrate and has a cut width of from 1.5 to 3.25 inches. The present invention also relates to methods of making and using the paper substrate, especially when such methods involve the production and use of the substrate as wallboard tape.

BRIEF DESCRIPTION OF THE DRAWINGS

FIG. 1: A flow chart that demonstrates the preferred methodology of making the paper substrate of the present invention stressing the addition points of a wet strength additive, an alkaline sizing agent, and an anionic promoter. Wet strength additive, an alkaline sizing agent, and an anionic promoter are preferably added at a any and/or all addition points A, B, C, and/or D.

DETAILED DESCRIPTION OF THE INVENTION

The present inventors have now discovered a paper substrate having a pH of at least 7.0 which, until now, was unable to meet the stringent physical properties required by the construction industries, as well as methods of making and using the same.

The paper substrate of the present invention may contain recycled fibers and/or virgin fibers. Recycled fibers differ from virgin fibers in that the fibers have gone through the drying process at least once.

The paper substrate of the present invention may contain from 1 to 99 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein.

Preferably, the sources of the cellulose fibers are from softwood and/or hardwood. The paper substrate of the present invention may contain from 50 to 100 wt %, preferably from 80 to 95%, cellulose fibers originating from softwood species based upon the total amount of cellulose fibers in the paper substrate. This range includes 50, 55, 60, 65, 70, 75, 80, 85, 90, 95, and 100 wt %, including any and all ranges and subranges therein, based upon the total amount of cellulose fibers in the paper substrate.

The paper substrate of the present invention may contain from 0 to 50 wt %, preferably from 5 to 20%, cellulose fibers originating from hardwood species based upon the total amount of cellulose fibers in the paper substrate. This range includes 0, 5, 10, 15, 20, 25, 30, 35, 40, 45 and 50 wt %, including any and all ranges and subranges therein, based upon the total amount of cellulose fibers in the paper substrate.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc means.

Examples of chemical means include, but is not limited to, conventional chemical fiber modification means. Examples of such modification of fibers may be, but is not limited to, those found in the following U.S. Pat. Nos. 6,592,717, 6,582,557, 6,579,415, 6,579,414, 6,506,282, 6,471,824, 6,361,651, 6,146,494, H1,704, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are hereby incorporated in their entirety by reference.

The paper substrate of the present invention may contain at least one wet strength additive. The wet strength additive may be cationic, anionic, neutral, and amphoteric. A preferred wet strength additive is cationic and/or contains a basic functional group. Examples of the wet strength additive may be, but is not limited to, polymeric amine epichlorohydrin (PAE), urea formaldehyde, melamine formaldehyde and glyoxylated polyacrylamide resins. Further examples of wet strength additives that may he incorporated in to the present invention may include, but is not limited to, those found in the following U.S. Pat. Nos. 6,355,137 and 6,171,440, which are hereby incorporated in their entirety by reference. Preferred wet strength additives include, but are not limited to, polymeric amine epichlorohydrin (PAF).

The paper substrate of the present invention may contain from 0.25 to 2.5 wt % of the wet strength additive based upon the total weight of the substrate. This range includes 0.25, 0.30, 0.35, 0.40, 0.45, 0.50, 0.6, 0.7, 0.8, 0.9, 1.0, 1.1, 1.2 1.3, 1.4 1.5, 1.6, 1.7, 1.8, 1.9, 2.0, 2.1, 2.2, 2.3, 2.4 and 2.5 wt %, including any and all ranges and subranges therein.

The paper substrate of the present invention may contain at least one alkaline sizing agent. Examples of the alkaline sizing agent may be, but is not limited to, unsaturated hydrocarbon compounds, such as C6 to C24, preferably C18 to C20, unsaturated hydrocarbon compounds and mixtures thereof.

Further examples of alkaline sizing agents that may be incorporated in to the present invention may include, but is not limited to, those found in the following U.S. Pat. Nos. 6,595,632, 6,512,146, 6,316,095, 6,273,997, 6,228,219, 6,165,321, 6,126,783, 6,033,526, 6,007,906, 5,766,417, 5,685,815, 5,527,430, 5,011,741, 4,710,422, and4,184,914, which are hereby incorporated in their entirety by reference. Preferred alkaline sizing agent may be, but not limited to, alkyl ketene dimer, alkenyl ketene dimer and alkenyl succinic anhydride.

The paper substrate of the present invention may contain from 0.05 to 1.5 wt % of the alkaline sizing agent based upon the total weight of the substrate. This range includes 0.05, 0.06, 0.07, 0.08, 0.09, 0.1, 0.2, 0.3, 0.4, 0.5, 0.6, 0.7, 0.8, 0.9, 1.0, 1.1, 1.2, 1.3, 1.4, and 1.5 wt %, including any and all ranges and subranges therein.

The paper substrate of the present invention may contain at least one anionic promoter. Examples of the anionic promoter may be, but is not limited to, polyacrylates, sulfonates, carboxymethyl celluloses, galactomannan hemicelluloses and polyacrylamides. Preferred anionic promoters include, but are not limited to polyacrylates such as Nalco 64873.

The paper substrate of the present invention may contain from 0.05 to 1.5 wt % of the anionic promoter based upon the total weight of the substrate. This range includes 0.05, 0.06, 0.07, 0.08, 0.09, 0.1, 0.2, 0.3, 0.4, 0.5, 0.6, 0.7, 0.8, 0.9, 1.0, 1.1, 1.2, 1.3, 1.4, and 1.5 wt %, including any and all ranges and subranges therein.

The paper substrate of the present invention may have a MD tensile as measured by conventional TAPPI method 494 of from 25 to 100, preferably from 40 to 90 lbf/inch width. This range includes MD tensile of 25, 30, 35, 40, 45, 50, 55, 60, 65, 70, 75, 80, 85, 90, 95, and 100 lbf/inch width, including any and all ranges and subranges therein.

The paper substrate of the present invention may have a CD tensile as measured by conventional TAPPI method 494 of from 5 to 50, preferably from 20 to 50 lbf/inch width, most preferably 25 to 40 lbf/inch width. This range includes CD tensile of 5, 10, 15, 20, 25, 30, 35, 40, 45, and 50 lbf/inch width, including any and all ranges and subranges therein.

The paper substrate of the present invention may have a wet strength as measured by conventional TAPPI method 456 of from 5 to 50, preferably from 10 to 25, most preferably from 15 to 25, lb/inch width. This range includes wet strengths of 5, 10, 15, 20, 25, 30, 35, 40, 45, and 50 lb/inch width, including any and all ranges and subranges therein.

The paper substrate of the present invention may have an internal bond as measured by conventional TAPPI method 541 of from 25 to 350, preferably from 50 to 250, most preferably from 100-200, mill ft-lb/sq. in. This range includes internal bond of 25, 30, 35, 40, 45, 50, 55, 60, 65, 70, 75, 80, 85, 90, 95, 100, 110, 125, 150, 175, 200, 225, 250, 275, 300, 325 and 350 milli ft-lb/sq. in, including any and all ranges and subranges therein.

The paper substrate of the present invention may have a pH of at least about 7.0 as measured by any conventional method such as a pH marker/pen and conventional TAPPI methods 252 and 529 (hot extraction test and/or surface pH test). The pH of the paper may be from about 7.0 to 14.0, preferably about 7.0 to 9.0, most preferably from about 7.1 to 8.5. This range includes pHs of 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.2, 9.4, 9.5, 9.6, 9.8, 10.0, 10.5, 11.0, 11.5, 12.0, 12.5, 13.0, 13.5, and 14.0, including any and all ranges and subranges therein.

The paper substrate according to the present invention may be made off of the paper machine having a basis weight of from 50 lb/3000 sq. ft. to 120 lb/3000 sq. ft, preferably from 70 to 120, and most preferably from 80-100 lb/3000 sq. ft. The basis weight of the substrate may be 50, 52, 54, 55, 56, 58, 60, 62, 64, 65, 66, 68, 70, 72, 74, 75, 76, 78, 80, 82, 84, 85, 86, 88, 90, 92, 94, 95, 96, 98, 100, 105, 110, 115 and 120 lb/3000 sq. ft, including any and all ranges and subranges therein.

The paper substrate according to the present invention may be made off of the paper machine having an apparent density of from 5.0 to 20.0, preferably 9.0 to 13.0, most preferably from 9.5 to 11.5, lb/3000 sq. ft.per 0.001 inch thickness. The apparent density of the substrate may be 5.0, 5.2, 5.4, 5.5, 5.6, 5.8, 6.0, 6.2, 6.4, 6.5, 6.6, 6.8, 7.0, 7.2, 7.4 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5, 18.0, 18.5, 19.0, 19.5 and 20.0 lb/3000 sq. ft.per 0.001 inch thickness, including any and all ranges and subranges therein.

The paper substrate according to the present invention may have a width off the winder of a paper machine of from 5 to 100 inches and can vary in length. The width of the paper substrate may be 5, 10, 15, 20, 25, 30, 35, 40, 45, 50, 55, 60, 65, 70, 75, 80, 85, 90, 95, 100 inches, including any and all ranges and subranges therein.

Additionally, the paper substrate according to the present invention may be cut into streamers that have a width of from 1.5 to 3.25 inches wide and may vary in length. The width of the paper substrate streamer may have a width of 1.50, 1.60, 1.70 1.75, 1.80, 1.85, 1.9, 1.95, 2.00, 2.10, 2.20, 2.30, 2.40, 2.50, 2.60, 2.70, 2.80, 2.90, 3.00, 3.05, 3.10, 3.15, 3.20, and 3.25 inches, including any and all ranges and subranges therein.

The paper substrate of the present invention may also include binders and inert substances including fillers, thickeners, and preservatives. Other inert substances include, but are not limited to silicas such as colloids and/or sols. Examples of silicas include, but are not limited to, sodium silicate and/or borosilicates. Another example of inert substances is solvents including but not limited to water. Examples of fillers include, but are not limited to; calcium carbonate, calcium sulfate hemihydrate, and calcium sulfate dehydrate. A preferable filler is calcium carbonate. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate.

The paper substrate of the present invention may contain from 0.001 to 20 wt % of the inert substances based on the total weight of the substrate, preferably from 0.01 to 10 wt %, most preferably 0.1 to 5.0 wt %, of each of at least one of the inert substances. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

The paper substrate of the present invention may also contain starch at a wt % of from 0.05 wt % to 20 wt % based on the total weight of the substrate. The wt % of starch contained by the substrate may be 0.05, 0.1, 0.2, 0.4, 0.5 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

The paper substrate may be made by contacting a plurality of cellulose fibers with a wet strength additive, an alkaline sizing agent, and an anionic promoter consecutively and/or simultaneously. Further, the contacting may occur in an aqueous environment having a pH of from 7.0 to 14.0. Still further, the contacting may occur at acceptable concentration levels that provide the paper substrate of the present invention to contain any of the above-mentioned amounts of cellulose fibers, wet strength additive, alkaline sizing agent, anionic promoter, filler, binder, thickener, and plasticizer isolated or in any combination thereof. The contacting may occur anytime in the papermaking process including, but not limited to the thick stock, thin stock, head box, size press, water box, and coater. The cellulose fibers, wet strength additive, alkaline sizing agent, anionic promoter may be contacted serially, consecutively, and/or simultaneously in any combination with each other. The cellulose fibers, wet strength additive, alkaline sizing agent, anionic promoter may he pre-mixed in any combination before addition to the paper-making process.

These methods of making the paper substrate of the present invention may be added to any conventional papermaking processes, as well as converting processes, including abrading, sanding, slitting, scoring, perforating, sparking, calendaring, sheet finishing, converting, coating, laminating, printing, etc. Preferred conventional processes include those tailored to produce paper substrates capable to be utilized as wallboard tape. Textbooks such as those described in the "Handbook for pulp and paper technologists" by G. A. Smook (1992), Angus Wilde Publications, describe such processes and is hereby incorporated, in its entirety, by reference.

The present invention is explained in more detail with the aid of the following embodiment example which is not intended to limit the scope of the present invention in any manner.

EXAMPLES

Example 1

Method

A method of making the product of the present invention is depicted in FIG. 1. FIG. 1 demonstrates a flow diagram of a specific papermaking process incorporating the serial and/or simultaneous addition of a wet strength additive, an alkaline sizing agent, an anionic promoter with a plurality of softwood and hardwood cellulose fibers at any one or more entry points selected from A, B, C, and/or D. The resultant paper substrate is summarized in Table 1. The papermaking process utilized the following stations of: pulp chest, refining, blending, sheet forming, drying, pressing, size press treatment, drying, calendaring, reeling, and winding. This can be followed by any conventional converting methods to produce, preferably, a wallboard tape.

TABLE 1

Paper substrate product made from the process summarized above and in FIG. 1

| Ingredient | Wt % based in the total weight of the paper substrate |
|---|---|
| Alkaline Sizing Agent | 0.1% |
| Wet Strength Additive | 1% |
| Anionic Promoter | 0.25% |
| Inert substances | 8.65% |
| Cellulosic Fibers | 90% (of which 90% Softwood and 10% Hardwood based on total weight of Cellulosic Fibers) |

As used throughout, ranges are used as a short hand for describing each and every value that is within the range, including all subranges therein.

Numerous modifications and variations on the present invention are possible in light of the above teachings. It is, therefore, to be understood that within the scope of the accompanying claims, the invention may be practiced otherwise than as specifically described herein.

All of the references, as well as their cited references, cited herein are hereby incorporated by reference with respect to relative portions related to the subject matter of the present invention and all of its embodiment

What is claimed is:

1. A method of making a wallboard tape, wherein the wallboard tape comprises a paper substrate having a pH of from about 7.0 to about 10.0 and an internal bond of from about 25 to about 350 milli ft-lb/sq. in. as measured by TAPPI method 541.1 and comprising a plurality of cellulose fibers, a wet strength additive, and an alkaline sizing agent, the method comprising the step of; contacting the cellulose fibers consecutively and/or simultaneously with the wet strength additive in an amount of from 0.25 to 2.5 wt % based on the total weight of the paper substrate, and the alkaline sizing agent in an amount of from 0.05 to 1.5 wt % based on the total weight of the paper substrate.

2. The method according to claim 1, wherein the paper substrate has a basis weight of from 50 to 120 lbs/3000 sq. ft.

3. The method according to claim 1 wherein the paper substrate has an apparent density of from 5.0 to 20 lb/3000 sq. ft. per 0.001 inch thickness.

4. The method according to claim 1, wherein the paper substrate has a MD Tensile of from 25 to 100 lbf/inch width.

5. The method according to claim 1, wherein the paper substrate has a CD Tensile of from 5 to 50 lbf/inch width.

6. The method according to claim 1, wherein at least a majority of the plurality of cellulose fibers are softwood fibers.

7. The method according to claim 1, wherein the paper substrate further comprises calcium carbonate.

8. The method according to claim 1, wherein the alkaline sizing agent is at least one member selected from the group consisting of alkyl ketene dimer, alkenyl ketene dimer and alkenyl succinic anhydride.

9. The method according to claim 1, wherein the paper substrate further comprises at least one member selected from the group consisting of a binder, filler, thickener, and preservative.

10. The method according to claim 1, wherein the paper substrate has a width off a winder of a paper machine of from 15 to 100 inches.

11. The method according to claim 1, wherein the wet strength agent is at least one member or combinations selected from the group consisting of a polymeric amine epichlorohydrin, urea formaldehyde, melamine formaldehyde and glyoxylated polyacrylamide resins.

12. The method according to claim 1, wherein the paper substrate further comprises calcium carbonate in at least one form selected from the group consisting of precipitated calcium carbonate and ground calcium carbonate.

13. The method according to claim 1, wherein the alkaline sizing agent is at least one unsaturated hydrocarbon having from 16 to 20 carbon atoms.

14. The method according to claim 1, wherein the paper substrate further comprises a binder.

15. The method according to claim 1, wherein said contacting step occurs within an aqueous environment having a pH of from 7.0 to 10.0.

16. The method according to claim 1, wherein the paper substrate of step (a) has an internal bond of from about 50 to about 250 milli ft-lb/sq. in. as measured by TAPPI method 541.

17. The method according to claim 1, further comprising slitting said paper substrate.

18. The method of according to claim 1, wherein the contacting of the cellulose fibers with the wet strength additive and the alkaline sizing agent is carried out simultaneously.

19. The method of according to claim 1, wherein the contacting of the cellulose fibers with the wet strength additive and the alkaline sizing agent is carried out consecutively.

20. The method according to claim 1, wherein the contacting occurs at the thick stock, thin stock, head box, size press, water box, coater, or a combination thereof.

21. The method according to claim 1, wherein the contacting occurs at the thin stock, thick stock, head box, size press, or a combination thereof.

22. The method according to claim 1, further comprising abrading at least one surface of the paper substrate.

23. The method according to claim 1, further comprising sanding at least one surface of the paper substrate.

24. The method according to claim 1, further comprising slitting said paper substrate.

25. A method of making a wallboard tape, comprising the steps of:

(a) preparing a paper substrate having a pH of from about 7.0 to about 10.0 and an internal bond of from about 25 to about 350 milli ft-lb/sq. in. as measured by TAPPI method 541 by contacting a plurality of cellulose fibers consecutively and/or simultaneously with a wet strength additive in an amount of from 0.25 to 2.5 wt % based on the total weight of the paper substrate, and an alkaline sizing agent in an amount of from 0.05 to 1.5 wt % based on the total weight of the paper substrate; and (b) converting the Paper substrate of step (a) to wallboard tape.

26. The method according to claim 25, wherein the alkaline sizing agent is at least one member selected from the group consisting of alkyl ketene dimer, alkenyl ketene dimer and alkenyl succinic anhydride.

27. The method according to claim 25, wherein the wet strength agent is at least one member or combinations selected from the group consisting of a polymeric amine epichlorohydrin, urea formaldehyde, melamine formaldehyde and glyoxylated polyacrylamide resins.

28. The method of according to claim 25, wherein the contacting of the cellulose fibers with the wet strength additive and the alkaline sizing agent is carried out simultaneously.

29. The method of according to claim 25, wherein the contacting of the cellulose fibers with the wet strength additive and the alkaline sizing agent is carried out consecutively.

30. The method according to claim 25, wherein the contacting occurs at the thick stock, thin stock, head box, size press, water box, coater, or any combination thereof.

31. The method according to claim 25, wherein the contacting occurs at the thin stock, thick stock, head box, size press, or any combination thereof.

32. The method according to claim 25, wherein the converting step comprises abrading at least one surface of the paper substrate.

33. The method according to claim 25, wherein the converting step comprises sanding at least one surface of the paper substrate.

* * * * *